United States Patent [19]

Van Roosmalen et al.

[11] Patent Number: 4,829,211

[45] Date of Patent: May 9, 1989

[54] METHOD OF MANUFACTURING A COLOR DISPLAY TUBE HAVING A MAGNETIC QUADRUPOLE POST-FOCUSING MASK AND A COLOR DISPLAY TUBE MADE BY THE METHOD

[75] Inventors: Johannes T. C. Van Roosmalen; Robert H. J. Fastenau; Jacob Koorneef; Matthijs J. Baan Hofman, All of Eindhoven; Johannes T. Klomp, Geldrop, all of Netherlands

[73] Assignee: U.S. Philips Corporation, New York, N.Y.

[21] Appl. No.: 164,306

[22] Filed: Mar. 4, 1988

[30] Foreign Application Priority Data

Mar. 6, 1987 [GB] United Kingdom ..... 8705307

[51] Int. Cl.[4] ..... H01J 29/07; H01J 9/236

[52] U.S. Cl. ..... 313/402; 313/403; 445/47; 335/284

[58] Field of Search ..... 313/402, 403; 445/417, 445/36; 335/284; 148/101, 103, 108

[56] References Cited

U.S. PATENT DOCUMENTS

| | | | |
|---|---|---|---|
| 4,135,111 | 1/1979 | Verweel | 313/403 |
| 4,339,688 | 7/1982 | Verweel | 313/403 |
| 4,513,272 | 4/1985 | Verweel et al. | 313/403 X |
| 4,614,501 | 9/1986 | Koorneef et al. | 313/403 X |

*Primary Examiner*—David K. Moore
*Assistant Examiner*—Michael Horabik
*Attorney, Agent, or Firm*—John C. Fox

[57] ABSTRACT

A method of manufacturing a color display tube having a magnetic quadrupole post-focusing mask, in which the mask is magnetized by magnetic field shaping means of soft iron, or the magnetic equivalent, having raised portions, for example strips placed against opposite sides of the mask sheet and subjected to an external strong magnetic field by an electromagnet to induce magnetic poles through the thickness of the mask sheet. The geometric arrangement of the raised portions of the field shaping means is such that cyclically a north pole, a south pole, a north pole and a south pole are induced into the sheet material surrounding each aperture. Using this technique, the entire area of a mask sheet can be magnetized in one operation. Also masks for small tubes and high definition tubes can be made.

19 Claims, 10 Drawing Sheets

METHOD OF MANUFACTURING A COLOR DISPLAY TUBE HAVING A MAGNETIC QUADRUPOLE POST-FOCUSING MASK AND A COLOR DISPLAY TUBE MADE BY THE METHOD

BACKGROUND OF THE INVENTION

The invention relates to a method of manufacturing a colour display tube having a magnetic quadrupole post-focusing mask, which mask is formed from a sheet of a magnetisable material having rows of apertures, and which mask is magnetised so that cyclically a north pole, a south pole, a north pole and a south pole are formed along the circumference of each aperture.

The invention also relates to a colour display tube made by the method.

A method of manufacturing a colour display tube having a magnetic quadrupole post-focusing mask is disclosed in British Patent Publication 2074782A, corresponding to U.S. Pat. No. 4,428,736, issued Jan. 31, 1984 and U.S. Pat. No. 4,513,272, issued Apr. 23, 1985. The object of magnetic post-focusing is to increase the transmission of the mask. In tubes without post-focusing, a very large part, for example 80 to 85%, of the electrons is intercepted by the so-called shadow mask. By using magnetic post-focusing, however, the apertures in the mask can be enlarged, since as a result of the focusing action in the apertures the electron spots impinging on the screen are considerably smaller than the apertures, so that sufficient space is present between the electron spots of the various electron beams to avoid their overlapping onto adjacent phosphors.

In the known tube, the mask is formed by a magnetisable sheet which has a large number of aperture and which is magnetised so that cyclically a north pole, a south pole, a north pole and a south pole are present along the circumference of each aperture. The sheet may be manufactured from a ferro-magnetic material or from a non-ferro-magnetic material on which a layer (or layers) of magnetisable material has (or have) been provided. A magnetic quadrupole lens is present in each of the apertures, which lens focuses the electron beam in one direction and defocuses it in a direction at right angles thereto to produce an elongated spot.

British Patent Specification 2074782A discloses two methods of magnetising a mask sheet. In one method, the magnetisation is carried out providing two mutually substantially perpendicularly oriented set of parallel conductors, one set on either side of the apertured mask sheet.

The conductors of each set are connected in series in a serpentine or meanderline fashion. The conductors are secured in predetermined positions on a block of synthetic resin. The spacing between the conductors is such that when placed against a mask sheet, pairs of conductors extend between adjacent rows of apertures. Thus when a potential difference is applied, current passes in opposite directions through the conductors of each pair. By suitably arranging the sets of conductors, a magnetic quadrupole is formed around each aperture in the mask in which oppositely directed poles are situated at an angle of 90° from each other and at an angle of approximately 45° with the longitudinal direction of the spot of the electron beam. Although this method could be used to magnetise quadrupole lenses in the whole mask sheet in one operation, in reality this suggestion is impractical, as will be illustrated by the following example.

The crosssectional size of the conductors is determined by a number of factors, two of which are the pitch of the rows of apertures and the spacing between adjacent rows. An exemplary cross section size of the conductor is 100 $\mu m \times 300$ $\mu m$ and the spacing between the conductors of each pair is 50 $\mu m$. An exemplary magnetising current is of the order of 600 amps and to avoid fusing the conductors, the current is applied in the form of pulses of say 20 $\mu s$ duration. An R.C.L. discharge circuit is used to provide these pulses and such a circuit requires physically large capacitors. A large number of conductors requires an equally large number of capacitors, causing the circuit to be unwieldy physically. A more practical approach would be to magnetise the small areas of the mask sheet in a step and repeat method. However, a step and repeat method produces magnetisation problems at the interfaces of each step. Since the magnetising current required is dependent on the thickness of the material, decreasing the pitch does not lead to a proportionate decrease in thickness of the material and so not to a decrease in magnetising current. Additionally, the development of heat in the magnetising devise becomes worse. In small display tubes, the material of the mask is not necessarily any thinner because the mask has to be of a certain rigidity.

In the other method disclosed in Specification 2074782A, the magnetisation is carried out by providing two mutually substantially perpendicularly oriented sets of permanently magnetised strips and arranging them with one set on either side of the mask sheet. The strips have alternate oppositely directed poles on the side facing the mask plate. The pitch of the strips is such that a strip extends between the apertures of each row and other strip extends over a row of apertures. A coil is provided around at least a part of the mask sheet with the strips provided thereagainst. A decaying magnetic alternating field is generated in the coil at the area of the mask sheet, which magnetic alternating field initially drives the magnetisable material of the sheet on both sides of the hysteresis curve into saturation. This hysteresis curve is superimposed on the constant magnetic field generated by the magnetic strips, which field actually induces the quadrupoles. This method also has a number of disadvantages in that the magnetic field induced by a step and repeat method is substantially constant over the entire area of the mask sheet. Also this other method is not suitable for magnetising small and/or high definition mask sheets because decreasing the pitch of the apertures in the mask sheet requires the permanently magnetised strips to be disposed closer and closer to each other while remaining physically separate. In practice such bunching of the strips is difficult to achieve.

Both of these known magnetising methods produce quadrupole lenses of substantially the same strength over the entire area of the shadow mask, and one disadvantage of this is that a focusing ring is produced. A focusing ring arises because with post-focusing, the beamlets transmitted by the apertures in the mask sheet are in focus over a ring-shape area of the screen, while the portions of the image inside and outside this ring-shaped area are out of focus to varying degrees. This is because the beamlets are focused more strongly in the peripheral regions (as a result of the beamlets passing obliquely through their respective lens field) than in the central region, where the beamlets pass substantially perpendicularly to their respective lens field. The presence of the focusing ring is perceptible to the eye, and as a compromise measure to reduce its effect, the beam spots at the screen are defocused slightly. This may lead to perceptible landing (colour purity) problems. However, such a compromise measure might be unnecessary if the focusing ring problem could be solved.

Another disadvantage of having a constant magnetic field produced by orthogonally related strips is that spot rotation occurs at the corners of the mask due to the electron beams passing obliquely through the apertures. Although this problem could be avoided by adapting the hole shape and rotating the quadrupoles, these known magnetising methods are too inflexible to allow such an adaption.

An object of the present invention is to overcome the above-mentioned disadvantages in the manufacture of colour display tubes having magnetic quadrupole post-focusing masks.

SUMMARY OF THE INVENTION

According to the present invention, there is provided a method of manufacturing a colour display tube having a magnetic quadrupole post-focusing mask, which mask is formed from a sheet of a magnetisable material having rows of apertures, and which mask is magnetized so that cyclically a north pole, a south pole, a north pole and a south pole are formed along the circumference of each aperture, characterized in that the forming of the post-focusing mask includes taking the sheet of permanently magnetisable material having rows of apertures, placing first and second non-permanently magnetisable field shaping means against opposite sides of the mask sheet, and applying a magnetic field to the mask sheet by way of the field shaping means, said field shaping means having raised portions which contact the mask sheet, the geometrical arrangement of the raised portions being such that cyclically a north pole, a south pole, a north pole and a south pole are induced into the sheet material surrounding each aperture.

Magnetising using, for example, soft iron field shaping means provides a number of advantages over the known magnetising methods. It is possible to magnetise the entire area of a mask sheet in a single operation. Also since the raised portion, which may comprise strips, can be placed closer to each other than is possible with permanently magnetised strips, then the method in accordance with the present invention can be used in providing quadrupole lens fields in small masks as well as high definition masks.

In implementing the present invention, the raised portions of the field shaping means comprise parallel strips, the strips being in contact with the mask, with the strips of the first shaping means extending substantially orthogonally to the strips of the second shaping means, the assembly of the first and second field shaping means with the mask sheet therebetween being disposed between the poles of an electromagnet. In one arrangement, the strips are aligned with the sheet material between the apertures, herein dams and in another arrangement the strips are aligned with and pass over the apertures in the mask sheet.

Problems of spot rotation can be overcome by the method in accordance with the present invention by altering the shapes of the apertures in the vicinity of the corners of the mask sheet and suitably adapting the raised portions of the field shaping means, for example by configuring them as a plurality of suitably shaped feet rather than strips, to produce quadrupole lens fields to suit these modified aperture shapes.

The mask sheet may comprise an alloy of: chromium in a portion of 25 to 27% by weight, cobalt in a proportion of 10 to 11% by weight and the balance being iron and any inevitable impurties.

In order to reduce or eliminate the occurrence of focusing rings, the strength of the quadrupole lenses may be varied selectively by varying the strength of magnetisation or by partial demagnetisation. Thus a display tube designer has a greater latitude in where to locate the shadow mask relative to the screen and at the same time avoid the half shadow problem which occurs when increasing the mask-to-screen distance relative to the pitch of conventional shadow masks.

According to another aspect of the present invention, there is provided a method of selectively adjusting the local magnetisation of a substantially planar apertured sheet material having permanent magnetic quadrupole lens fields induced around the apertures therein, comprising rotatably mounting the magnetised sheet material so that its plane of rotation lies between the pole shoes of at least one electromagnet, rotating the sheet material, moving the pole shoes of the electromagnet relative to the axis of rotation of the mask sheet and simultaneously applying a predetermined demagnetising field to the mask sheet.

According to another aspect of the present invention, the degree of magnetisation of selected areas of a mask sheet is adjusted independently of the magnetisation method used.

According to a further aspect of the present invention, there is provided a method of adjusting the magnetisation of a substantially planar apertured sheet material having permanent magnetic lens fields induced around the apertures therein, comprising placing the magnetised sheet between the pole shoes of an electromagnet, the profiles of the facing surfaces of the pole shoes relative to the plane of the sheet material being such that when a demagnetising field is applied by the electromagnet to the mask sheet, the distance between the facing surfaces is larger at those points at which the residual field is to be greater and smaller at those points at which the residual field is to be smaller.

BRIEF DESCRIPTION OF THE DRAWINGS

The present invention will now be described, by way of example, with reference to the accompanying drawings, wherein.

In the drawings, the same reference numerals have been used to indicate the corresponding features.

DESCRIPTION OF THE PREFERRED EMBODIMENTS

Figure 1:
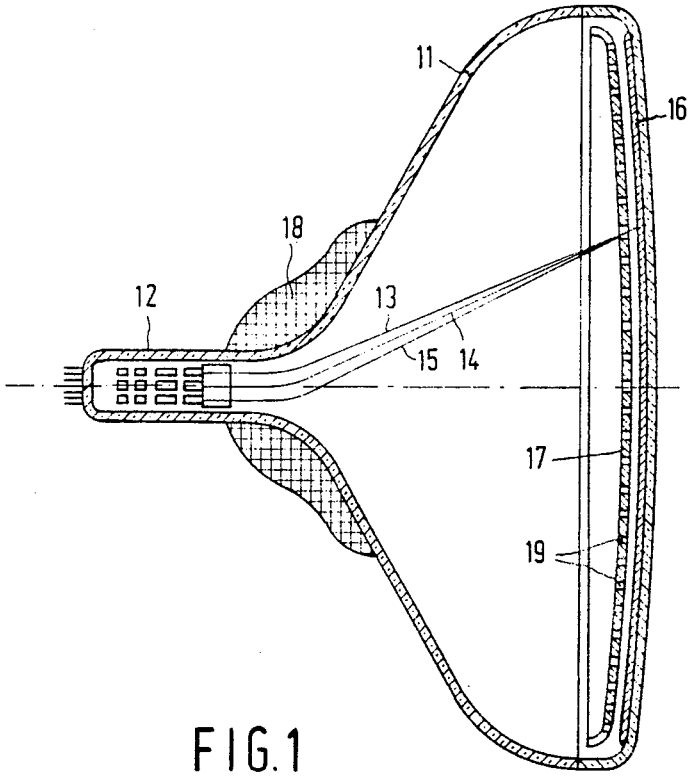
FIG. 1 is a sectional view of a colour display tube having a magnetic quadrupole post-focusing mask.

The tube shown in FIG. 1 comprises a glass envelope 11, means 12 to generate three electron beams 13, 14 and 15, a display screen 16, a magnetic quadrupole post-focusing mask 17 and deflection coils 18. The electron beams 13, 14 and 15, are generated in one plane, the plane of the drawing of FIG. 1, and are deflected over the display screen 16 by means of the deflection coils 18. The display screen 16 comprises a large number of phosphor strings luminescing in red (R), green (G) and blue (B), the longitudinal direction of which strips is perpendicular to the plane of the drawing of FIG. 1. In normal use of the tube, the phosphor strips are vertical and FIG. 1 thus is a horizontal cross-section of the tube. The mask 17, which will be described in greater detail with reference to FIGS. 2 and 3, comprises a large number of apertures 19 which are shown diagrammatically only in FIG. 1. A magnetic quadrupole lens is formed in each of the apertures 19. The three electron beams 13, 14 and 15 pass through the apertures 19 at a small angle with each other and consequently each impinge only on phosphor strips of one colour. The apertures 19 in the mask 17 are thus positioned very accurately relative to the phosphor strips of the display screen 16.

Figure 2:
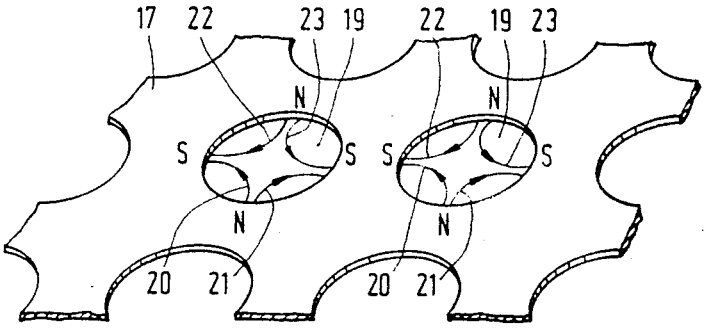
FIG. 2 is a perspective view of a part of the mask of the display tube shown in FIG. 1.

FIG. 2 is a perspective view of a part of the mask 17 of the tube shown in FIG. 1. The mask 17 comprises a sheet of a permanent magnetic material, for example, a rollable steel which can be etched for the manufacture of the apertures 19 and comprising, for example, an Fe-Co-Cr alloy having the composition in per cent by weight, cobalt 10 to 11%, chromium 25 to 27% and the balance iron. Such an alloy is disclosed in published European Patent Specification 0 129 943, corresponding to U.S. Pat. No. 4,616,154, issued Oct. 7, 1986, details of which are incorporated by way of reference. The sheet is then magnetized in such manner that the magnet poles (shown in FIG. 2 by N and S) are obtained. The four magnetic poles (N-S-N-S) constitute a magnetic quadrupole field for which a few field lines are denoted by 20, 21, 22 and 23. Methods by which the magnetisation is carried out will be explained in detail later with reference to FIGS. 4*a*, 4*b*, 5*a*, 5*b*, 6*a*, 6*b*, 6*c* and 13. In FIG. 2 the apertures 19 are circular. However, the apertures may have other shapes, for example, square with rounded corners or hexagonal with or without rounded corners. Also, the shapes may differ between the centre and the edges of the sheet. In the FIG. 2 embodiment, the thickness of the mask 17 is equal to 0.1 mm and the apertures 19 have a radius of the order of 0.25 mm, the pitch between apertures being 0.6 mm.

Figure 3A:
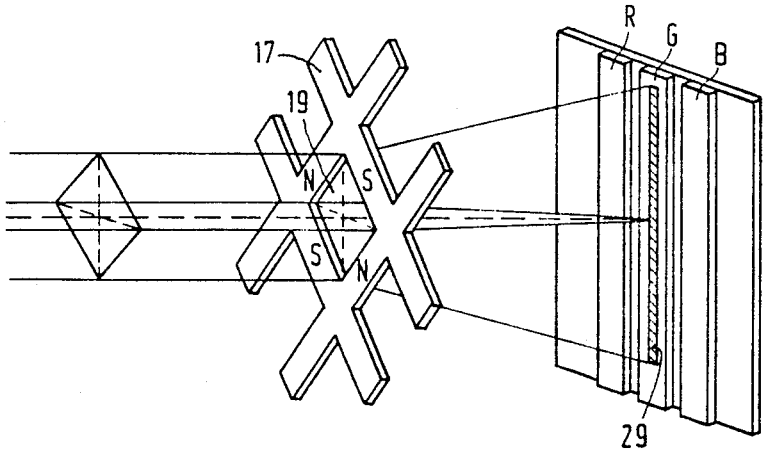
FIG. 3*a* is a diagrammatic perspective view of a part of the mask and screen of the display tube of FIG. 1, which explains the principle of the focusing by means of a magnetic quadrupole lens.

The principle of a magnetic quadrupole lens will be explained with reference to FIG. 3*a*, which shows diagrammatically such a magnetic quadrupole lens in an aperture 19 of the mask 17. The variation of the magnetisation along the edge of the aperture 19 is denoted by N,S,N,S, in such manner that the quadrupole field is formed. The electron beam or beamlet which passed through the aperture 19 is focused in the horizontally drawn plane and is defocused in the vertically drawn plane so that, when the display screen is exactly in the horizontal focal point, the electron spot 29 is formed. The cross-section of the electron beam is thus elongated in the vertical direction and is made narrower in the horizontal direction.

Figure 3B:
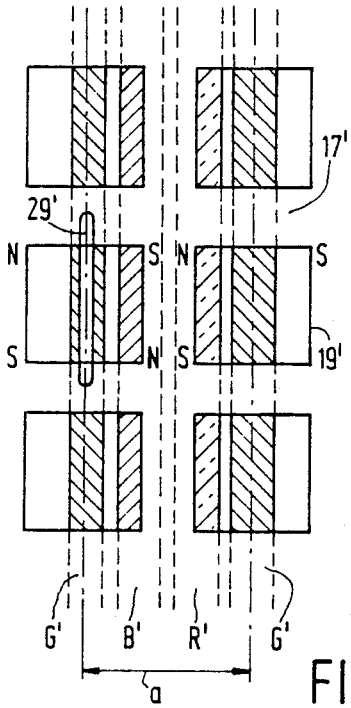
FIGS. 3*b* and 3*c* are diagrams which illustrate the the two basic alternatives of aperture arrangement for a quadrupole mask mode in accordance with the present invention.
Figure 3C:
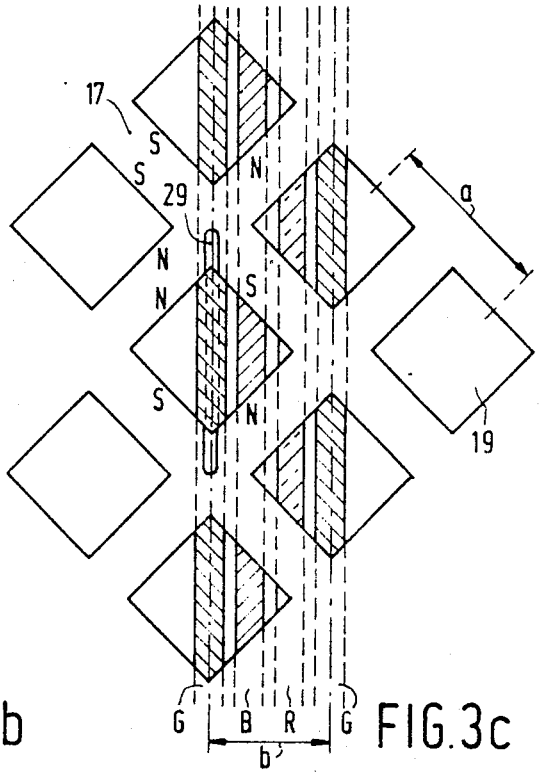

In FIG. 3*b*, the longitudinal direction of the rows of apertures is the same as the longitudinal direction of the phosphor lines (R′, G′ and B′) on the display screen. The poles denoted by N,S,N and S are present at the corners of each aperture 19′ in FIG. 3*b*. The longitudinal direction of the elongate spot 29′ varies in the longitudinal direction of the phosphor lines (R′, G′, and B′). The distance between two phosphor lines luminescing in the same colour is equal to the pitch a of the rows of apertures. FIG. 3*c* shows an alternative higher definition configuration which can be obtained when the longitudinal direction of the rows of apertures 19 makes an angle of 45° with the longitudinal direction of the phosphor lines (R, G and B) on the display screen. The poles are present on the centres of the sides of aperture 19. The longitudinal direction of the elongate spot 29 varies in the longitudinal direction of the phosphor lines. Since the direction of elongation is diagonally of the apertures than a stronger lens field can be used so that a longer, narrower spot 29 can be produced compared to the FIG. 3*b* arrangement. Consequently, the pitch *b* between two phosphor lines luminescing in the same colour can be smaller than the pitch *a* of the rows of apertures 19′.

A method of manufacturing a colour display tube having a mask with a large number of magnetic quadrupole lenses will now be described.

Figure 4A:
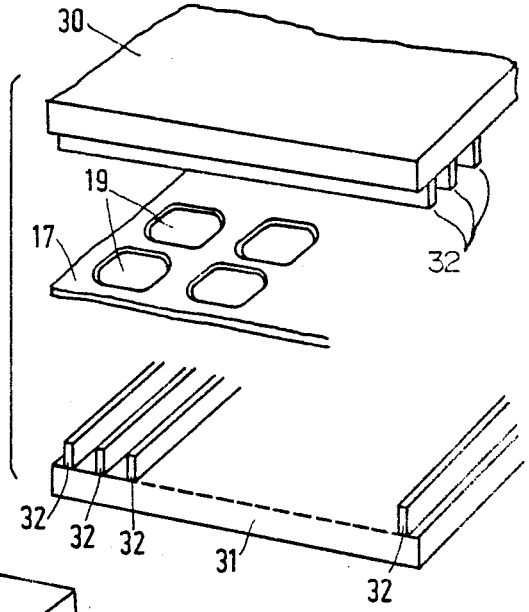
FIGS. 4*a* and 4*b* are diagrams which illustrate an embodiment of the magnetisation method in accordance with the present invention.

FIG. 4*a* is a perspective view of a part of the mask sheet 17 with apertures 19. Magnetic field shapers 30 and 31 are juxtaposed above and below the mask 17. Each of the field shapers 30 and 31 are made of soft iron or a suitable material having magnetic characteristics similar to soft iron and has raised parallel strips 32 etched, moulded or otherwise formed therein. Preferably the field shapers 30, 31 are as large as the mask sheet 17 which is flat at this stage of manufacture. The strips 32 in the field shaper 30 cross the strips 32 in the field shaper 31 at right angles. The mutual pitch of the strips 32 is such that if the field shapers 30 and 31 are placed one on each side of the mask sheet 17 a strip 32 is present on each side of a row of apertures 19.

Figure 4B:
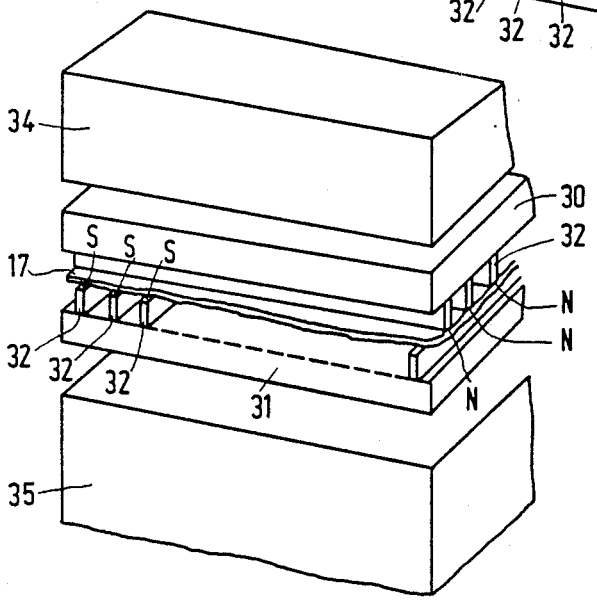

FIG. 4*b* shows the situation in which the field shapers 30 and 31 are provided on the mask 17. The mask 17 together with the field shapers 30 and 31 are placed between pole pieces 34, 35 of a powerful electro-magnet which is energised to induce the required field in the mask 17. The magnetisation takes place through the thickness of the mask material. Subsequently in a separate operation the mask sheet 17 is formed into its final shape.

As a large electro-magnet can be used to induce the quadrupoles in the mask 17, then it is possible for the field shapers 30, 31 to be of such a size that an entire mask sheet 17 can be magnetised in a single operation, which is a significant advance over the step and repeat method of the prior art. Additionally, as the strips 32 are non-permanently magnetised then they can de disposed close together if required so that the method can be applied to masks for smaller sizes of display tubes as well as for high definition display tubes.

In the simplest embodiment of the present invention the pole pieces 34, 35 of the electro-magnet are flat so that substantially equal strength multipoles are induced over the entire area of the mask sheet 17.

However, it is preferred for the strengths of the quadrupoles to be varied so that the focusing ring problem can be avoided. The focusing ring problem arises from having substantially equal strength quadrupole lenses, but different mask-to-screen distances along the electron beam trajectory between the centre and the edges/corners, so that only over a circular or annular area are the electron beamlets substantially in focus. The effect becomes even more noticeable in the peripheral regions of the displayed image because the beamlets pass obliquely through the focusing field thereby strengthening the focusing effect (or reducing the focal length) as the mask to screen distance along the electron beam trajectory increases. This circular area termed the focusing ring is discernible to the eye particularly if some phosphor saturation occurs. In the colour display tubes made in accordance with the present invention this problem can be overcome if the strengths of the quadrupoles become weaker from the centre outwards so that the electron beam remains substantially in focus as the mask-to-screen distance along the electron beam trajectory varies.

Figure 5A:
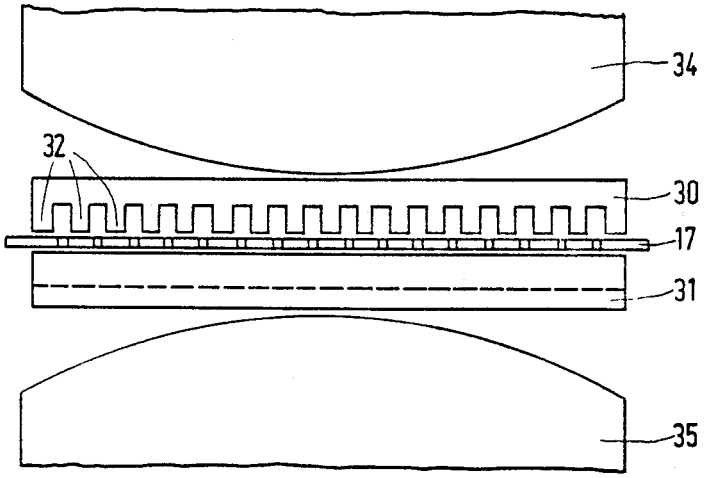
FIGS. 5*a* and 5*b* and 6*a*, 6*b* and 6*c* are diagrammatic views of two different field shaping means by which the magnetisation can be varied across the mask sheet.

FIG 5*a* illustrates one method by which the strengths of the induced quadrupoles can be varied from the centre outwards. In this example the magnetic field shapers 30, 31 have strips 32 of substantially constant pitch and width and these strips contact the mask sheet 17. The pole pieces 34, 35 of the electromagnet have convexly curved opposing faces as viewed end-on. When the pole pieces are brought into contact with the field shapers 30, 31 they clamp the assembly in the central area so that the strength of the magnetic quadrupole lenses induced is greatest at the centre and is least at the edges and corners. Although the end faces are shown as being circularly convex, they may be shaped differently in order to obtain a desired distribution of the strengths of the quadrupole lenses.

Figure 5B:
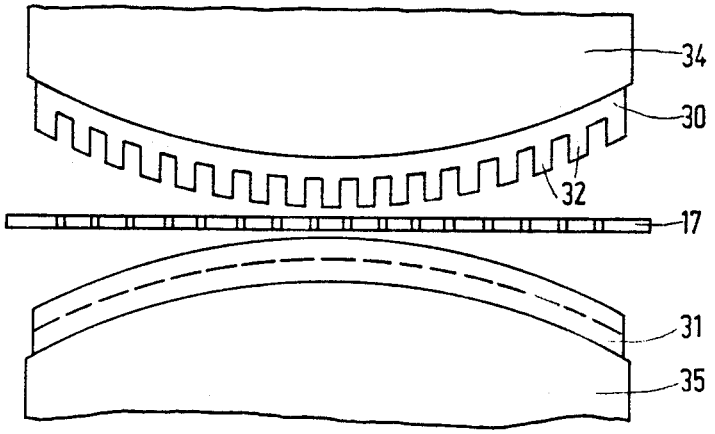

FIG. 5*b* illustrates an alternative method to that shown in FIG. 5*a*. In FIG. 5*b* the field shapers 30, 31 conform to the shape of the convexly curved end faces of the pole pieces 34, 35. The strength of the magnetic quadrupole lenses is greatest at the centre and is least at the edges and corners.

Figure 6A:
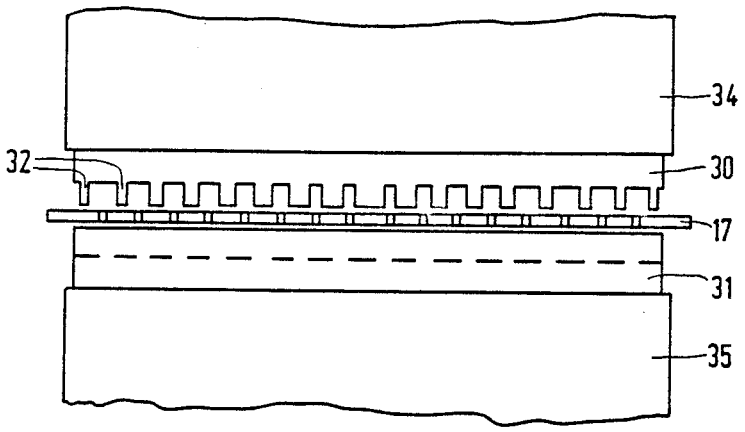

FIG. 6*a* illustrates another magnetisation method by which the strengths of the induced quadrupole lenses can be varied from the centre outwards but the pole pieces have flat ends. The magnetic field shapers 30, 31 comprise orthogonally arranged strips 32 but the thickness of the strips decreases from the centre outwards. Consequently when the field shapers 30, 31 with the intervening mask sheet are clamped between the flat ended pole pieces 34, 35 the field density is greater at the centre than at the edges because the area of contact is greater at the centre. If necessary the variation of the thickness of the strips 32 may be such that any desired strength distribution of the quadrupole lenses can be obtained.

Figure 6B:
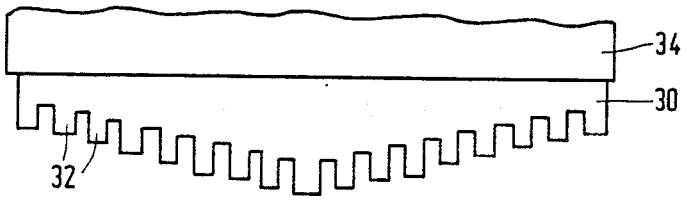
Figure 6C:
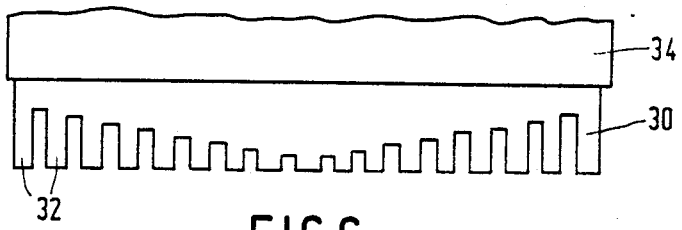

FIGS. 6*b* and 6*c* show variants in which the strips can be of substantially constant width and pitch but the strengths of the magnetic quadrupoles induced at the centre of the mask are greater than those at the edges. For convenience only one pole piece 34 and associated field shaper 30 are shown, the other (not shown) field shaper being similar but rotated through 90° so that the strips 32 are orthogonal to each other. In FIG. 6*b* the strips 32 terminate at their free ends at different heights relative to the centre strip. In FIG. 6*c* , the gaps between adjacent strips 32 are of progressively greater height proceeding from the centre outwards so that the induced quadrupoles are weaker at the edges.

Obviously various combinations of the techniques illustrated in FIGS. 5*a* to 6*c* can be made.

A further method is to induce strong and substantially homogeneous quadrupoles over the entire area of the mask sheet 17 by any suitable magnetising means and then selectively partially demagnetise the quadrupole in a predetermined manner. This method is illustrated diagrammatically in FIG. 7*a*. The mask sheet 17 which has had strong quadrupole induced in it, is rotatably mounted so that the plane of the sheet lies between the pole pieces 38, 39 of a demagnetising yoke 40 about which a coil 41 is wound. The size of the pole pieces 38, 39 is such that only an elemental area of the mask 17 is between them at any one time.

Initially the pole pieces 38, 39 are disposed close to the centre of the mask sheet 17 which is rotated in the direction indicated by the arrow 42. The yoke 40 is removed progressively away from the centre of the rotating mask sheet 17 whilst simultaneously the demagnetising current $I_D$ applied to the coil 41 is increased in a predetermined manner as shown for example by the graph of FIG. 7*b*.

Figure 7A:
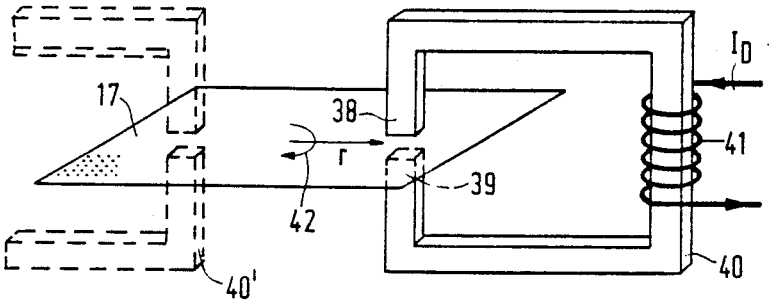
FIGS. 7*a* and 7*b* are a diagram and a graph, respectively, which illustrate an embodiment of a method and means for adjusting the strength of the quadrupole lenses.
Figure 7B:
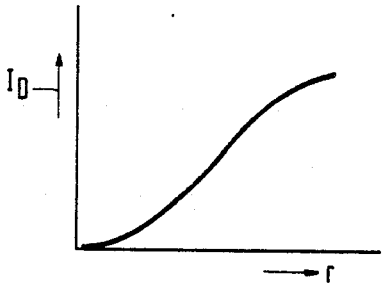

When implementing the method described with reference to FIGS. 7*a* and 7*b*, it is possible to use more than one demagnetising yoke. For example a second yoke 40' may be provided which is operatively linked to the yoke 40 so that as they are moved outwards from the centre the desired demagnetisation fields are provided. Additional demagnetising yokes may be provided which are operatively linked to the other yoke or yokes and are moved in other radial directions from the centre.

Figure 8:
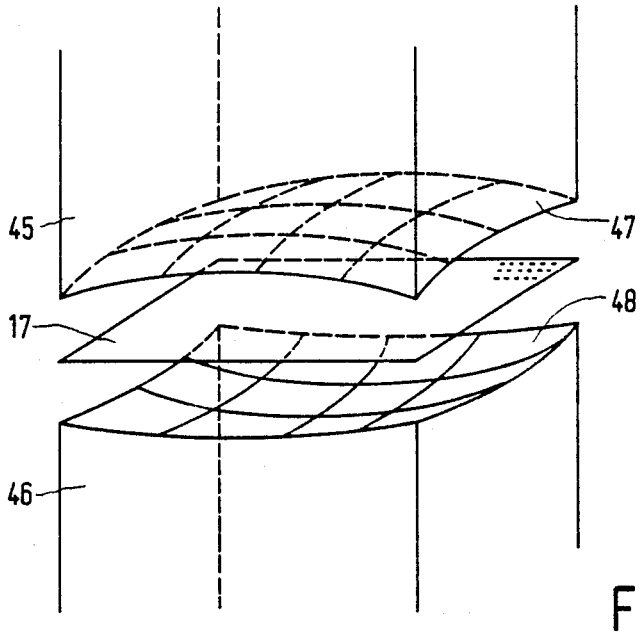
FIG. 8 is a diagram which illustrates another embodiment of a method and means for adjusting the strength of the quadrupole lenses.

A further method is shown in FIG. 8 in which a demagnetising yoke is provided having pole pieces 45, 46 with concave shaped faces 47, 48. The shape of faces 47, 48 is adapted so that for a certain demagnetising field, the degree of partial demagnetisation of the previously magnetised mask sheet 17 takes place in a predetermined manner across the entire mask sheet 17.

Irrespective of which method is used the fact that the strengths of the multipoles can be adjusted so that they are weaker at the edges than at the centre eliminates or reduces significantly the focusing ring problem. In doing this the spot sizes on the screen are such that they remain the same proportion of a phosphor line width.

Thus the risk of unwanted phosphor saturation occurring is avoided.

By being able to vary the strengths of the quadrupole lens fields across the mask sheet 17, a display tube designer has some latitude because he is not constrained by the magnetic shadow mask. In a colour display tube the mask-to-screen distance $d_n$, a measured normal to the screen has a fixed value at the centre which value may vary within defined limits over the entire faceplate area. However the mask-to-screen distance, $d_t$, measured along the trajectory will be greater at the edges than at the centre due to beamlet passing obliquely through the space. In the case of a magnetic shadow mask tube, the strength of the quadrupoles at different points on the shadow mask should be such that $d_t = k f_L$, where $f_L$ is the focal length of the quadrupole lens, and k has a value between 0.8 and 1.2. It may be that this relationship cannot be achieved because the minimum focal length of the lenses is too large to offer good focusing at the screen, that is the value of k is too small. Accordingly a display tube designer has to consider alternative tube designs for example in which the mask-to-screen distance is 2d or 4d. Adjusting the focal length of the quadrupole lenses by graduating their magnetisation or by selective demagnetisation then the spots remain in the desired focusing tolerance range all over the screen. Additonally because the shadow mask is a focusing mask then the aperture sizes can remain relatively large in the $2d_n$, $4d_n$ and so on cases thus maintaining the brightness of the image while having a well-focused spot. The half shadow problem associated with beamlets diverging between the shadow mask and the screen, particularly when the distance therebetween is relatively large, can be mitigated or eliminated by means of a post-focusing mask.

Figure 9:
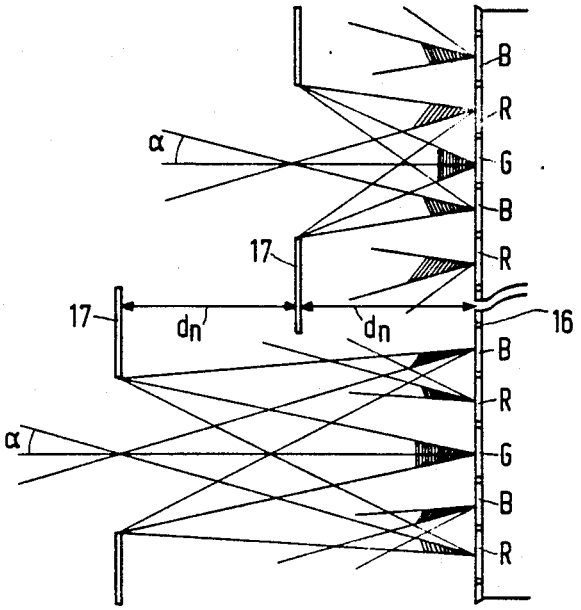
FIG. 9 is a diagram illustrating the effect of doubling the mask-to-screen distance.

FIG. 9 illustrates the practical effect of doubling the mask-to-screen distance, $d_n$. In the upper part of the drawing the "red" and "blue" electron beams converge at an angle $\alpha$ with respect to the central, green electron beam. Doubling the distance $d_n$ as illustrated in the lower part of FIG. 9 means that for the same beam convergence angle $\alpha$ and phosphor pitch, the points of impingement of the "red" and "blue" beams are displaced heightwise in the drawing by $\frac{1}{3}$ of the pitch of a phosphor triplet so that they land respectively on the blue and red phosphors (instead of vice versa when the mask-to-screen distance equals $d_n$). Subject to being able to produce quadrupole lenses of the required focal length, the mask-to-screen distance can be increased further in increments of distance $d_n$ although multiples of three times $d_n$ have to be avoided because all the beamlets will land on the green phosphor.

Figure 10:
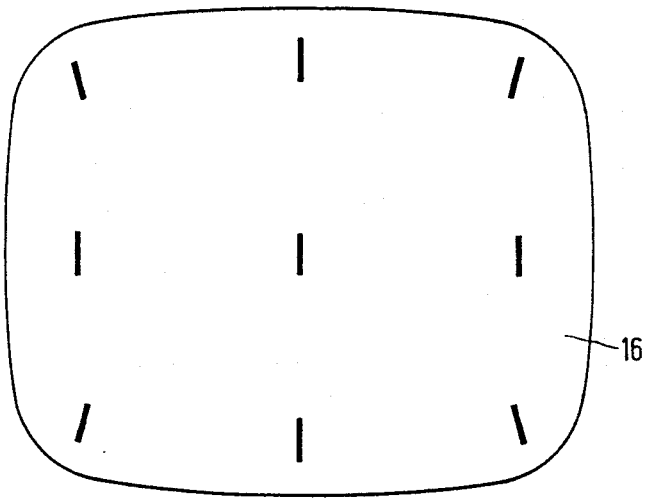
FIG. 10 is a diagram of a screen and illustrates the problem of spot rotation.

Another problem which can be resolved by means of the present invention is that of spot rotation at the corners of the screen 16. This problem is illustrated in FIG. 10 and is due to the oblique incidence of the in-line shaped spots at the corners of the screen 16 being rotated with respect to the desired vertical position. This problem can be alleviated by adjusting the aperture shapes in the mask sheet 17 at the corners and adapting the magnetisation of the quadrupole to suit the modified aperture shaps.

Figure 11:
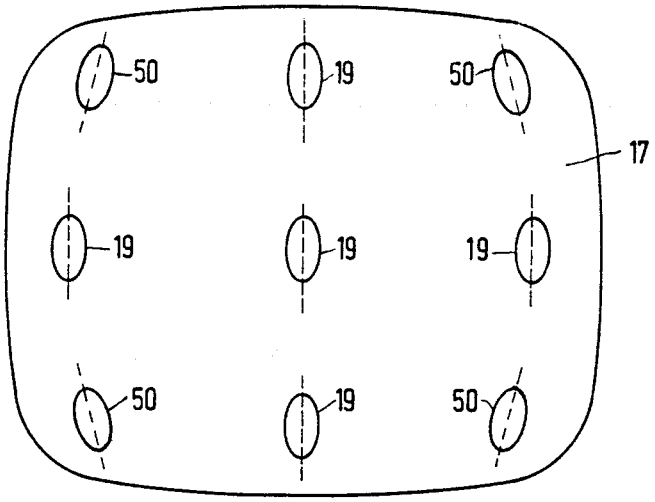
FIG. 11 is a diagrammatic view of a mask having elliptical holes, which holes have been rotated at the corners.

In the case of the mask sheet 17 comprising elliptically shaped holes then to reduce the effect of spot rotation, the apertures 50 in the vicinity of each corner can be rotated from the vertical somewhat as shown in FIG. 11. In order to magnetise the quadrupole then in designing field shapers 30, 31 the shape of the strips are suitably adjusted in the corner areas.

Figure 12:
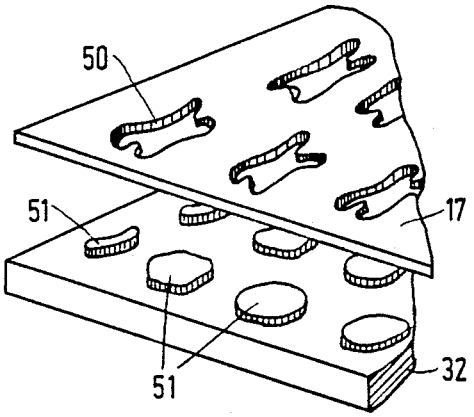
FIG. 12 is a diagram which illustrates a corner of the mask sheet and a corner of one field shaper having raised portions in the form of feet, the other field shaper (not shown) being a mirror image of the illustrated one.
Figure 13:
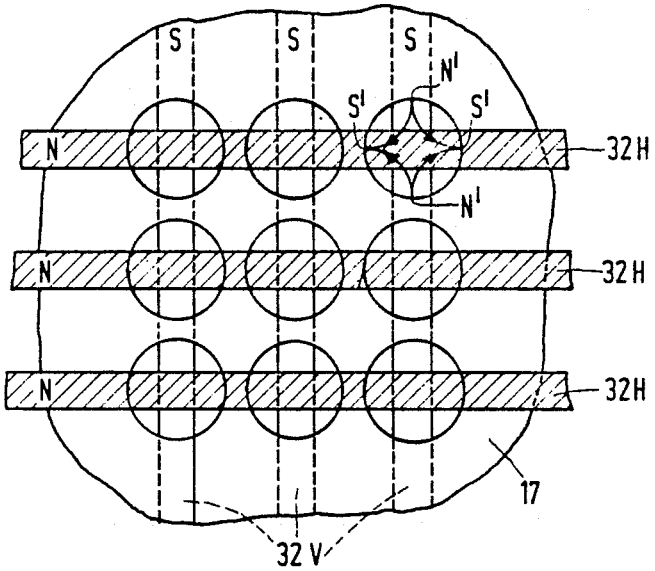
FIG. 13 is a diagrammatic illustration of the magnetising method in accordance with the present invention in which the orthogonally related strips pass over the holes rather than along the dams therebetween.

Alternatively, particularly if the shapes of the apertures 50 are somewhat complicated such as star-shaped then feet 51 (FIG. 12) may be formed instead of the strips 32 at those positions where it is desired to have magnetic poles. The position of the feet 51 and their shape may be varied as desired.

It is also possible, as an alternative or as an addition to having the feet 51, to have a mixture of strips 32 for the central region and feet for the edges and the corners.

Although it is preferred for the strips 32 to be arranged over the spaces or dams between the apertures in the mask sheet 17, it is possible for the strips 32 to be arranged so that they intersect over the centre of the holes in the mask sheet 17. This is illustrated diagrammatically in FIG. 13. In this figure, the horizontal strips 32H are disposed above the mask sheet 17 and the vertical strips 32 V are disposed beneath the mask sheet 17. The letters N and S associated with the strips 32H and 32V indicate respectively the north and south polarity induced into the respective pole shoe. N.' and S' indicate the north and south poles induced into the mask sheet 17 material.

Figure 14:
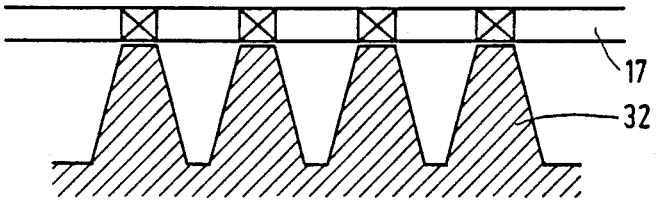
FIGS. 14 and 15 are diagrams which illustrate two alternative profiles of the strips.
Figure 15:
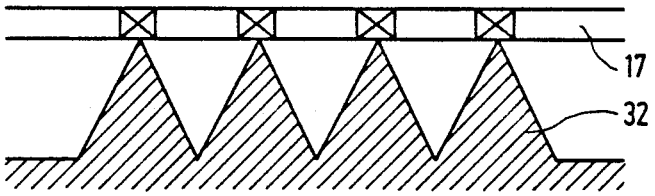

In the illustrated embodiments described so far the cross-sectional shape of the strips 32 has been shown as square or rectangular. However they may also be trapezoidal as shown in FIG. 14 or wedge (or triangular) shaped as shown in FIG. 15. Such shapes may be necessary in those cases where the aperture pitch in the mask sheet 17 is small.

In implementing an embodiment of the method in accordance with the present invention a flat, unmagnetised shadow mask sheet material comprising Co 10.5% by weight, Cr 26.5% by weight and the balance Fe and having a thickness of between 100 $\mu$m and 300 $\mu$m, for example 150 $\mu$m, is etched to provided the required pattern of apertures. The material is annealed by heating it to 680° C. and reducing the temperature to room temperature in accordance with a predetermined time/-temperature profile —giving it a coercivity of 30 kA/m and a remanace $B^r$ of the order of 1 Tesla as well as a residual maximum plastic elongation of 10%. The material is now in a condition in which it can be magnetized. The sheet is then magnetised in accordance with the method decribed to produce strong quadrupole lens fields of substantially homogeneous strengths in the sheet material. The strengths of the respective lens fields is reduced as desired by, for example, the method described with respect to FIGS. **5*a* and 5*b***. Thereafter, the sheet material is formed into its final shape and mounted in a framework so that it is resistant to shock. At the appropriate time it is associated with a faceplate and a striped phosphor screen is produced by any known suitable exposure method such as that described in German Patent Application 2248878.

In the foregoing description, reference has been made to the primary field induced being quadrupole. However, higher order multipoles may be present and their aberrating effect can be tolerated provided the width of the spot is such as to ensure colour purity.

What is claimed is:

1. A method of manufacturing a colour display tube having a magnetic quadrupole post-focusing mask, which mask is formed of a sheet of a magnetisable material having rows of apertures, and having dams between the apertures, and which mask is magnetized so that cyclically a north pole, a south pole, a north pole and a south pole are formed along with circumference of each aperture, characterized in that the forming of the post-focusing mask includes placing first and second non-permanently magnetisable field shaping means against opposite sides of the mask sheet, and applying a magnetic field to the mask sheet by way of the field shaping means, said field shaping means having raised non-permanent magnetisable portions which contact the mask sheet, the geometrical arrangement of the raised portion being such that cyclically a north pole, a south pole, a north pole and a south pole are induced into the sheet material surrounding each aperture.

2. A method as claimed in claim 1, wherein the raised portions of the field shaping means comprise parallel strips, the strips of the first field shaping means extending substantially orthogonally to the strips of the second field shaping means, and wherein the magnetisation is effected by an electromagnet.

3. A method as claimed in claim 2, wherein the strips are aligned with the dams in the mask sheet.

4. A method as claimed in claim 2, wherein the strips are aligned with the apertures in the mask sheet.

5. A method as claimed in claim 2, wherein the shapes of the apertures in the vicinity of the corners of the mask sheet are such as to reduce the effects of spot rotation.

6. A method as claimed in claim 1 wherein at least some of the raised portions of the field shapers comprise feet.

7. A method as claimed in claim 1 wherein the pitch of the raised portions is varied to suit the aperture pitch of the mask.

8. A method as claimed in claim 1 wherein the entire area of the mask is magnetised in a single operation.

9. A method as claimed in claim 1, wherein the mask material is any alloy having the composition comprising chromium in a proportion of 25 to 27% by weight, cobalt in proportion of 10 to 11% by weight and the balance iron.

10. A method as claimed in claim 1, wherein the strength of the magnetising field applied by the field shapers is varied in a predetermined manner across the mask sheet.

11. A method as claimed in claim 10, wherein the strength of the magnetising field is altered by varying the heightwise geometry of the applied magnetic field.

12. A method as claimed in claim 10, wherein the strength of the magnetising field is altered by varying the widthwise geometry of the applied magnetic field.

13. A method as claimed in claim 1, wherein the strength of the quadrupole lenses is varied selectively by partial demagnetisation.

14. A method as claimed in claim 1, in which the mask is made by taking a flat sheet of a permanently magnetisable material, etching the rows of apertures in the sheet, annealing the etched sheet material to render it magnetisable, producing strong quadrupole lens fields in the sheet, adjusting the strength of the quadrupole lens fields by selective partial demagnetisation of the lens fields, and shaping the mask sheet to its final shape.

15. A method of selectively adjusting the local magnetisation of a substantially planar apertured sheet material having permanent magnetic quadrupole lens fields induced around the apertures therein, comprising rotatably mounting the magnetised sheet material so that its plane of rotation at an elemental area of the mask sheet lies between the pole shoes of at least one electromagnet, rotating the sheet material, moving the pole shoes of the electromagnet transverse relative to the axis of rotation of the mask sheet progressively away from the center of said mask sheet and simultaneously applying a predetermined demagnetising field to the mask sheet and increasing the demagnetizing current as pole shoes are moved away from the centre of said mask sheet.

16. A method as claimed in claim 15, wherein the demagnetising field increases in a direction from the centre to the edges of the mask sheet.

17. A method of adjusting the magnetisation of a substantially planar apertured sheet material having permanent magnetic lens fields induced around the apertures therein, comprising placing the magnetised sheet between the pole shoes with concave faces of an electromagnet, the profiles of the facing surfaces of the pole shoes relative to the plane of the sheet material being such that when a demagnetising field is applied by the electromagnet to the mask sheet, the distance between the facing surfaces is larger at those points at which the residual field is to be greater and smaller at those points at which the residual field is to be smaller.

18. A colour display tube including an envelope, means for producing three electron beams, a cathodoluminescent screen comprising contiguous triplets of phosphor elements luminescing in different colours and a magnetic quadrupole post-focusing mask made by the method of claim 1.

19. A colour display tube as claimed in claim 18, wherein the post-focusing mask is disposed at such a distance from the screen that electron beamlets formed by an aperture of the mask land on their dedicated phosphor elements in different triplets.

* * * * *